US008011997B2

(12) United States Patent
Voigt et al.

(10) Patent No.: US 8,011,997 B2
(45) Date of Patent: Sep. 6, 2011

(54) GUARD FOR AN ELECTRIC MACHINE TOOL, ELECTRIC MACHINE TOOL, AND SYSTEM COMPRISING A GUARD AND ELECTRIC MACHINE TOOL

(75) Inventors: Mike Voigt, Gaildorf (DE); Albert Kleider, Schwaebisch Hall (DE); Kurt Neef, Gaildorf-Grossaltdorf (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/797,663

(22) Filed: Jun. 10, 2010

(65) Prior Publication Data

US 2010/0248599 A1 Sep. 30, 2010

Related U.S. Application Data

(63) Continuation of application No. 10/552,225, filed as application No. PCT/DE2004/001716 on Jul. 30, 2004, now abandoned.

(30) Foreign Application Priority Data

Oct. 17, 2003 (DE) ..... 103 48 395

(51) Int. Cl.
*B24B 55/04* (2006.01)

(52) U.S. Cl. ..... 451/452; 451/455; 451/359

(58) Field of Classification Search ..... 15/359, 15/451–455; 83/478
See application file for complete search history.

(56) References Cited

U.S. PATENT DOCUMENTS

| | | | | |
|---|---|---|---|---|
| 5,005,321 | A * | 4/1991 | Barth et al. | 451/359 |
| 5,163,252 | A * | 11/1992 | Garner et al. | 451/451 |
| 6,464,573 | B1 * | 10/2002 | Keller | 451/451 |
| 6,949,017 | B2 * | 9/2005 | Koschel et al. | 451/358 |
| 7,014,547 | B2 * | 3/2006 | Kleider | 451/359 |
| 7,311,589 | B2 * | 12/2007 | Wiker | 451/451 |

FOREIGN PATENT DOCUMENTS

EP 978353 A2 * 2/2000

* cited by examiner

*Primary Examiner* — Dung Van Nguyen
(74) *Attorney, Agent, or Firm* — Michael J. Striker

(57) ABSTRACT

A guard for a power tool with a rotatably driven insertion tool (14) is configured to cover at least portions of the insertion tool (14). At least one blocking means (32, 40) prevents the insertion tool (14) from turning around an axis of rotation (18).

21 Claims, 2 Drawing Sheets

GUARD FOR AN ELECTRIC MACHINE TOOL, ELECTRIC MACHINE TOOL, AND SYSTEM COMPRISING A GUARD AND ELECTRIC MACHINE TOOL

CROSS-REFERENCE

The present application is a continuation application of U.S. application Ser. No. 10/552,225 filed Oct. 6, 2005 now abandoned. The invention described and claimed hereinbelow is also described in PCT/DE 2004/001716, filed on Jul. 30, 2004 and DE 103 48 395.0, filed on Oct. 17, 2003. This German Patent Application, whose subject matter is incorporated here by reference, provides the basis for a claim of priority of invention under 35 U.S.C. 119 (a)-(d).

BACKGROUND OF THE INVENTION

The present invention is directed to a guard for a power tool, a power tool, and a system composed of guard and power tool.

It is known to provide guards for power tools with rotatably driven insertion tools—angle grinders in particular—to protect an operator from injury that could occur if the insertion tool shatters and fragments are slung outward.

SUMMARY OF THE INVENTION

The present invention is directed to a guard for a power tool with a rotatably driven insertion tool, with which at least portions of the insertion tool can be covered.

According to the present invention, at least one blocking means is provided that at least prevents the insertion tool from turning around an axis of rotation. As a result, protection against contact with the insertion tool is improved and a protective function against a shattering of the insertion tool is ensured. As a result, fragments slung off of the shattered insertion tool are prevented from rotating the guard on the drive shaft so far that the fragments pose a risk to an operator. If damage occurs, the blocking of the guard rotation is independent of a tightening torque used to attach the guard.

The blocking means is preferably formed by a stop cam in a flange designed for fastening that extends substantially parallel to the axis of rotation. The guard is installed with the flange on the power tool, thereby enabling a space-saving and easy-to-handle arrangement of the rotation-prevention means. The stop cam can point inward. An arrangement with an outwardly-oriented stop cam is also possible. One skilled in the art will select an arrangement that is suitable for the power tool being used.

If the blocking means is formed by a stop cam in a clamp connected with the flange, a high degree of safety can be obtained using means that are easy to manufacture. The rotation-prevention means is not dependent on a clamping force given by a tightening torque of an attachment screw used to attach the clamp to a collar. The rotation-prevention means is effective even if the attachment screw was accidentally undertightened. If the stop cam hits a stop, the guard is held securely in this position.

If the stop cam, in the installed state, points toward a collar, a corresponding stop can be provided on the collar of the power tool. The entire rotation-prevention means is located inside the guard.

If the blocking means is formed by an outwardly-projecting blocking lug on the guard, it can be machined—economically and easily—directly out of the sheet metal of the guard. As an option, the blocking lug can also be welded on, adhesively bonded or screwed into place. The blocking lug can also be installed as a retrofit. Preferably, the blocking lug can project outward. As an alternative, it can also point inward, in a suitable location.

If the blocking lug is located on the flange, the rotation-prevention means can be positioned in a space-saving manner.

The blocking lug can also be located on a surface extending substantially perpendicular to the axis of rotation, adjacent to an opening for a drive shaft of the insertion tool to be covered by the guard. As a result, the blocking lug advantageously does not extend into the operator's working area.

The present invention also relates to a power tool with an electric motor located in a housing, the electric motor rotatably driving the insertion tool.

According to the present invention, a rotation-prevention means is provided that at least prevents the insertion tool from being released in the direction of an operator. The guard can be limited, at the least, from rotating around an axis of rotation of the insertion tool. As a result, protection against contact with the insertion tool is improved and a protective function against a shattering of the insertion tool is ensured. As a result, fragments slung off of the shattered insertion tool are prevented from rotating the guard on the drive shaft so far that the fragments pose a risk to an operator.

If the rotation-prevention means includes a stop means that corresponds with the blocking means, rotation of the guard can be limited to a narrow angular range, or it can be prevented entirely.

If a collar includes a guide groove with a limiting groove located at an angle thereto, a clamp with a stop cam pressed through on its inside can be inserted. The guard can only be rotated within the limiting groove; this limits the angular range of the guard. The guard can be fixed in any position in the limiting groove.

If a stop that projects outward at an angle is provided on the housing, a blocking lug and/or a stop cam can hit it, and the guard can be prevented from rotating in an undesired manner.

The present invention also relates to a system composed of guard and power tool.

According to the present invention, a rotation-prevention means is provided with a blocking means on the guard side and with a corresponding stop means on the power tool side. The blocking means can be an integral part of the guard, e.g., a blocking lug or a cam, or it can be provided on a fastening device with which the guard is connected with the power tool. The guard is reliably prevented from rotating past the stop. By aligning the blocking means and stop means accordingly, an angular range within which rotation is permitted can be actively specified.

If the rotation-prevention means can be triggered by the insertion tool acting on the guard, the operator's safety can be ensured in case of maloperation. The guard can be rotated, at the most, within an angular range in which safety is still ensured. Installation of the guard in a position that is common for normal operation of the power tool is not prevented.

Particularly preferably, the power tool is designed as an angle grinder, the grinding disc of which is covered by a guard, at least in some areas. If the grinding disc shatters, the guard can no longer be driven by the fragments in the original direction of rotation so far that the operator could be struck by fragments. The rotation-prevention means is independent of a tightening torque used to attach the guard to a collar.

BRIEF DESCRIPTION OF THE DRAWINGS

Further advantages result from the description of the drawing, below. Two exemplary embodiments of the present invention are shown in the drawing. The drawing, the description and the claims contain numerous features in combination. One skilled in the art will also advantageously consider the features individually and combine them to form further reasonable combinations.

DETAILED DESCRIPTION OF THE EXEMPLARY EMBODIMENTS

Figure 1:
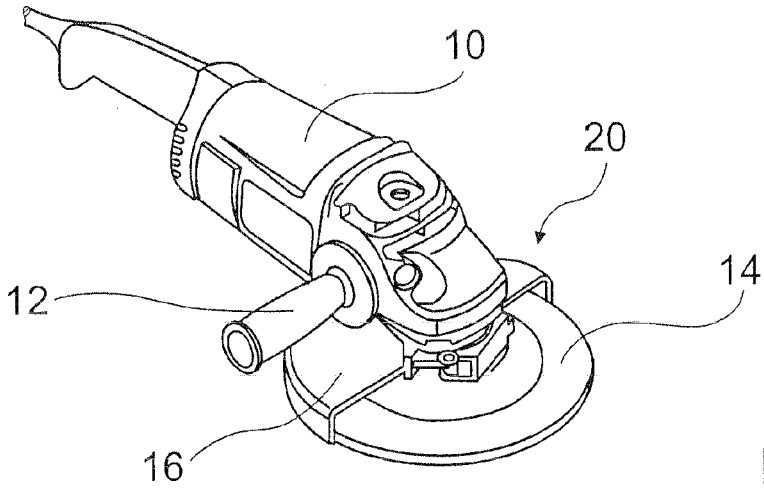
FIG. 1 Shows a preferred angle grinder.
Figure 2:
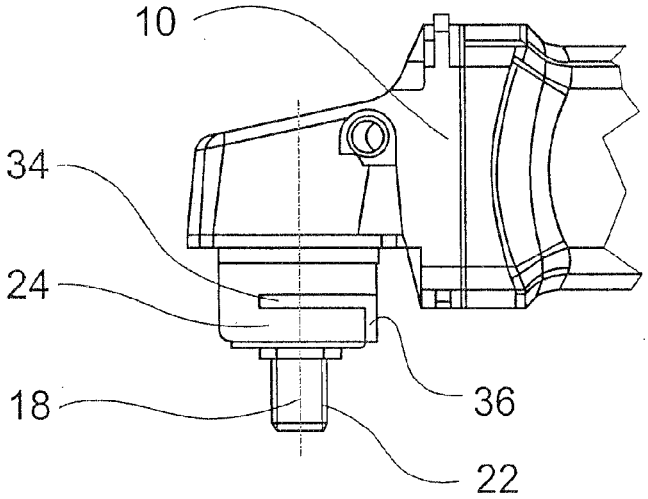
FIG. 2 Shows a schematic depiction of a side view according to a first exemplary embodiment, FIG. 3 Shows a depiction of a maximum angular range of rotation of the guard, FIG. 4 Shows a schematic view of a clamp for attaching the guard, FIG. 5 Shows a top view of a guard with clamp, FIG. 6 Shows a rotation-prevention means according to a second exemplary embodiment.

A power tool designed as a preferred angle grinder is shown in FIG. 1. An electric motor (not shown) is located in a housing 10, the electric motor rotatably driving an insertion tool 14, which is a grinding disc in this case. With an angle grinder, an output shaft of the electric motor is usually positioned perpendicularly to a drive shaft of the insertion tool. The angle grinder can be held and guided using a handle 12 that projects outwardly at an angle. A guard 16 covers insertion tool 14 to the extent that protection against contact by an operator is ensured. Guard 16 is designed as a semicircle with a flange on the periphery, the flange extending downward at the periphery and covering half of the surface and the edge of grinding disc 14. Guard 16 includes, e.g., a flange 30 projecting upwardly from the center of its imaginary circular area and extending substantially parallel to an axis of rotation 18, with a clamp 26 attached thereto, and is fixed to a collar 24 by way of said clamp 26 (FIGS. 2-5).

To ensure—if insertion tool 14 shatters—that guard 16 is not rotated so far that fragments can strike the operator, a rotation-prevention means 20 is provided according to the present invention that at least limits guard 16 from rotating around an axis of rotation of insertion tool 14 and/or collar 24.

Figure 3:
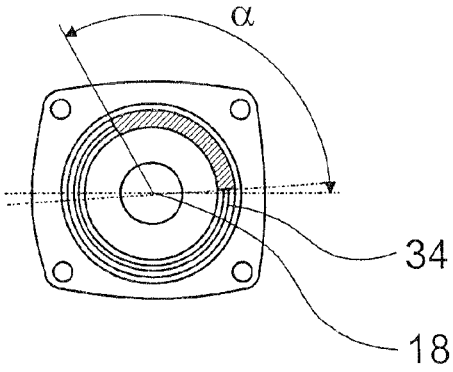
Figure 4:
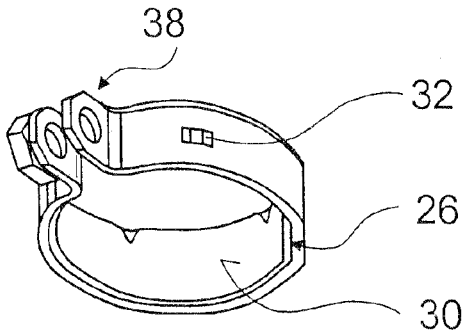

FIGS. 2 through 5 show a first preferred exemplary embodiment of a rotation-prevention means 20. In the figures, components that are basically identical are all labeled with the same reference numerals. A blocking means in the form of a stop cam 32 is provided, on the guard side, on a collar 24 of a drive shaft 22, the blocking means being formed in a clamp 26 for attaching a guard 16 to collar 24, and which is pressed through toward the inside of clamp 26 (FIG. 4). An insertion groove 36 with a limiting groove 34 extending substantially perpendicular thereto is provided in collar 24, the limiting groove forming a stop means that corresponds with stop cam 32. If guard 16 is rotated when insertion tool 14 shatters, limiting groove 34 limits a possible rotation around an axis of rotation 18 to an angular range $\alpha$ (FIG. 3). The rotation is blocked independently of a torque used to tighten an attachment screw 28 used to fix clamp 26 around collar 24, the rotation being blocked by one end or the other end of limiting groove 34.

Clamp 26 is shown in greater detail in FIG. 4. Clamp 26 surrounds a flange 30 that projects outward from guard 16 and fixedly clamps flange 30 of guard 16 to collar 24 of drive shaft 22. To install guard 16, stop cam 32 is guided via insertion groove 36 into limiting groove 34. Attachment screw 28 is screwed into a screw receptacle 38. By tightening attachment screw 28, guard 16 can be clamped more or less tightly to collar 24. Advantageously, limiting groove 34 extends away from insertion groove 36 in the direction of rotation of insertion tool 14. Guard 16 can only be rotated, at a maximum, in angular range $\alpha$, across which limiting groove 34 extends (FIG. 3).

Figure 5:
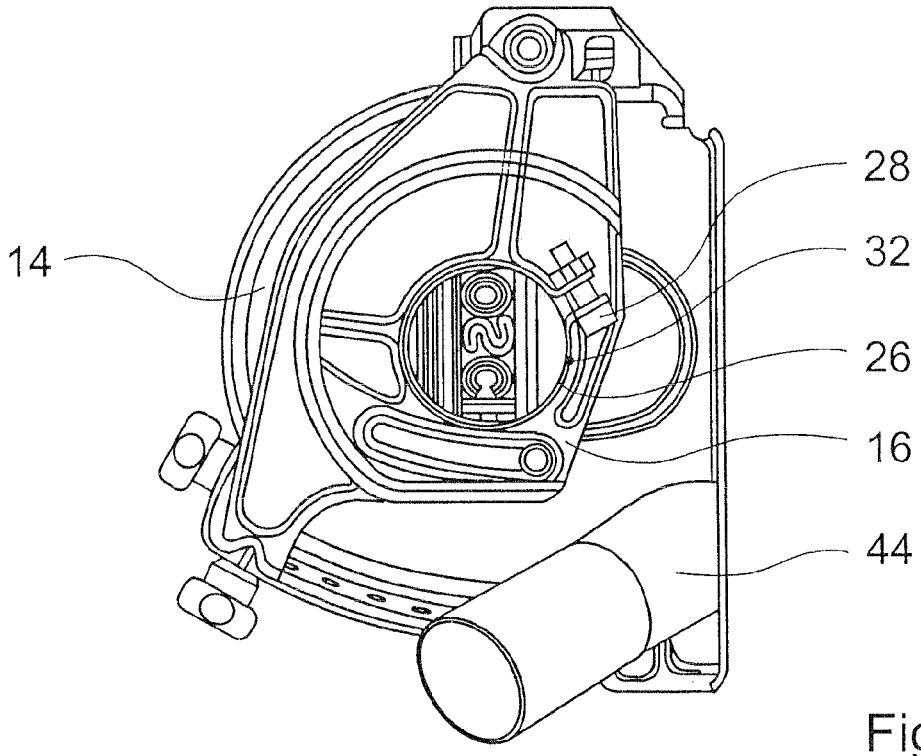

FIG. 5 shows a top view of the arrangement. A suction pipe 44 can also be integrated in guard 16, suction pipe enabling the extraction of dust produced while working with insertion tool 14. Stop cam 32 is pressed through on the inside of clamp 26 with which guard 16 is fixed to collar 24 and extends into limiting groove 34 of collar 24.

Figure 6:
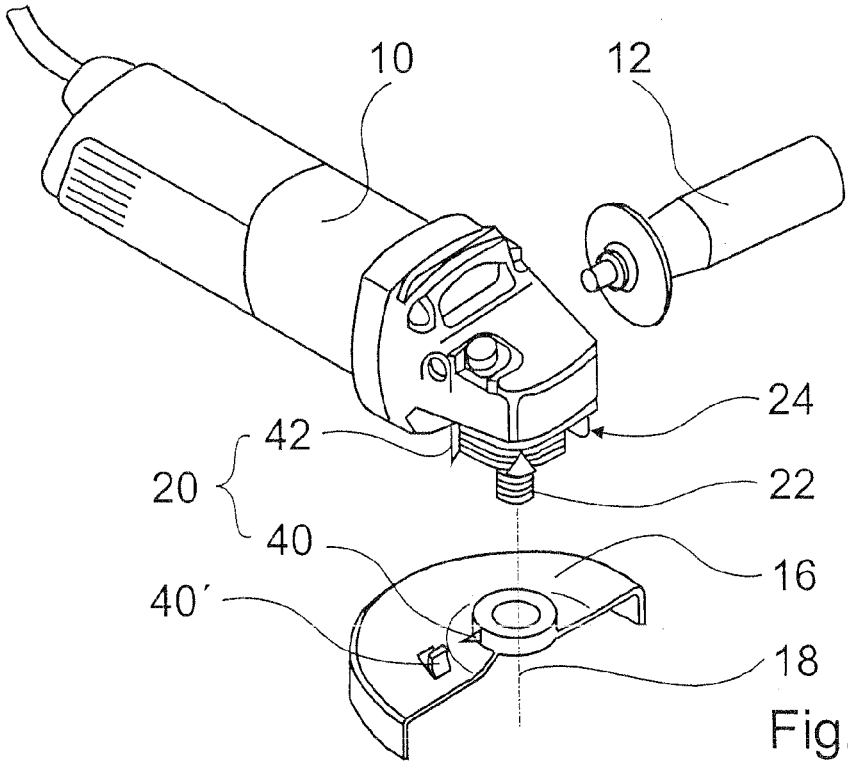

A further exemplary embodiment of rotation-prevention means 20 is depicted in FIG. 6. In that case, a blocking lug 40 is formed on guard 16 that is formed out of the sheet metal of guard 16 by being partially punched out and bent. As an option, blocking lug 40 can also be welded on, adhesively bonded, or screwed in place. Blocking lug 40 extends outward out of the surface of guard 16 such that it can come in contact with a stop 42 provided on housing 10. Stop 42 can be formed directly in housing 10, or it can be welded on, adhesively bonded, or screwed in place. Stop 42 or blocking lug 40 can also be installed as a retrofit. As an alternative to blocking lug 40, a blocking lug 40' can be created out of a wall of guard 16 oriented perpendicularly to axis of rotation 18 by being partially punched out and bent.

Blocking lug 40 hits stop 42 if guard 16 rotates on collar 24 in the direction of rotation. Guard 16 can be mounted on collar 24 using a common clamp 26. Clamp 26 can also be equipped with a rotation-prevention means 20 according to the present invention, of the type described with reference to the preceding figures.

Advantageously, guard 16 can be installed such that blocking means 32, 40 are both positioned as closely adjacent to stop means 34, 42 as possible. As a result, guard 16 can be prevented from rotating on collar 24, the rotation being induced when insertion tool 14 shatters.

REFERENCE NUMERALS

10 Housing
12 Handle
14 Insertion tool
16 Guard
18 Axis of rotation
20 Rotation-prevention means
22 Drive shaft
24 Collar
26 Clamp
28 Attachment screw
30 Flange
32 Stop cam
34 Limiting groove
36 Insertion groove
38 Screwed connection
40 Blocking lug
42 Stop
44 Suction pipe
$\alpha$ Angle of rotation

What is claimed is:

1. A system composed of a guard and a power tool, comprising:

a rotation-prevention element, wherein said rotation-prevention element has at least one blocking lug;

at least one stop provided on a housing of said power tool, wherein said at least one blocking lug extends outwardly from a surface of said guard such that said at least one blocking lug contacts said at least one stop on said housing;

an attachment element for clamping the guard to the power tool, wherein said at least one stop limits rotation of the guard in the event of shattering of an insertion tool in an operation mode of the power tool, and wherein said blocking lug is formed from a wall of the guard oriented perpendicularly to an axis of rotation of said power tool by being partially punched out and bent.

2. The system as recited in claim 1, wherein said blocking lug is partially punched out and bent in a sheet metal material forming said guard.

3. The system as recited in claim 1, wherein said blocking lug is attached to said guard by welding, adhesive bonding, or screws.

4. The system as recited in claim 1, wherein said stop is formed directly in said housing.

5. The system as recited in claim 1, wherein said stop is attached to said housing by welding, adhesive bonded, or screws.

6. The system as recited in claim 1, wherein the guard is positioned so that the at least one blocking lug is positioned as closely adjacent as possible to said at least one stop.

7. The system as recited in claim 1, wherein the rotation-prevention element can be triggered by an insertion tool acting on the guard.

8. The system as recited in claim 1, wherein the entire rotation-prevention element is located inside the guard.

9. The system as recited in claim 1, wherein the rotation-prevention element is provided so that blocking of rotation of the guard is independent of a tightening torque used to attach the guard.

10. The system as recited in claim 1, wherein the rotation-prevention element limits rotation of the guard to a narrow angular range.

11. The system as recited in claim 1, wherein the rotation-prevention element entirely prevents rotation of the guard.

12. The system as recited in claim 1, wherein the at least one blocking lug and at least one stop are aligned correspondingly to each other, so that an angular range within which rotation is permitted is specifiable.

13. The system as recited in claim 12, wherein the narrow angular range has an angle, which is greater than 0°.

14. A power tool, comprising:

an electric motor located in a housing;

an insertion tool rotatably driven by the electric motor;

a rotation-prevention element configured to prevent the insertion tool from being released in a direction of an operator, wherein said rotation-prevention element has at least one blocking lug;

at least one stop provided on said housing, wherein said at least one blocking lug extends outwardly from a surface of said guard such that said at least one blocking lug contacts said at least one stop on said housing; and an attachment element for clamping the guard to the power tool, wherein said at least one stop limits rotation of the guard in the event of shattering of an insertion tool in an operation mode of the power tool, and wherein said at least one blocking lug is formed from a wall of the guard oriented perpendicularly to an axis of rotation of said power tool being partially punched out and bent.

15. The power tool as recited in claim 14, wherein said blocking lug is partially punched out and bent in a sheet metal material forming said guard.

16. The power tool as recited in claim 14, wherein said at least one blocking lug is attached to said guard by welding, adhesive bonding, or screws.

17. The power tool as recited in claim 14, wherein said at least one stop is formed directly in said housing.

18. The power tool as recited in claim 14, wherein said at least one stop is attached to said housing by welding, adhesive bonded, or screws.

19. The power tool as recited in claim 14, wherein the guard is positioned so that the at least one blocking lug is positioned as closely adjacent as possible to said at least one stop.

20. The power tool as recited in claim 14, wherein the rotation-prevention element can be triggered by an insertion tool acting on the guard.

21. A system composed of a guard and a power tool, comprising:

a rotation-prevention element provided with at least one blocking lug on a guard side and with at least one corresponding stop on a power tool side, wherein said at least one blocking lug extends outwardly from a surface of said guard such that said at least one blocking lug contacts said at least one stop, wherein said at least one blocking lug is formed from a wall of the guard oriented perpendicularly to an axis of rotation of said power tool by being partially punched out and bent;

an attachment element for clamping the guard to the power tool, wherein the guard is attached in a normal operation mode to a collar by a force closure and the guard is attached to the collar by a form closure in the event of shattering of the insertion tool.

* * * * *